US005524944A

United States Patent [19]

Berg

[11] Patent Number: 5,524,944

[45] Date of Patent: Jun. 11, 1996

[54] LATCH

[75] Inventor: Robert D. W. Berg, La Junta, Colo.

[73] Assignee: DeBourgh Manufacturing Company, La Junta, Colo.

[21] Appl. No.: 286,676

[22] Filed: Aug. 5, 1994

[51] Int. Cl.[6] ..... E05C 1/08

[52] U.S. Cl. ..... 292/163; 292/148; 292/334; 292/DIG. 68

[58] Field of Search ..... 292/DIG. 68, 163, 292/DIG. 62, 63, 148, 151, 334, 64, 65, 335, 140, 164

[56] References Cited

U.S. PATENT DOCUMENTS

| | | | |
|---|---|---|---|
| 973,001 | 10/1910 | Churchill | 292/DIG. 68 X |
| 1,697,950 | 1/1929 | Dexter | 292/DIG. 62 X |
| 1,970,267 | 8/1934 | Bales | 292/334 |
| 2,147,903 | 2/1939 | Kaser | 292/DIG. 68 X |
| 2,336,458 | 12/1943 | Bales et al. | 292/148 X |
| 3,374,020 | 3/1968 | Berg | 292/175 |

*Primary Examiner*—Rodney M. Lindsey
*Attorney, Agent, or Firm*—Ralph F. Crandell; Holland & Hart

[57] ABSTRACT

A lockable latch mechanism for receiving the hasp of a padlock and locking a hinged door to a door jamb to prevent opening of the door when the door is closed and the latch is in engagement with the jamb. The latch includes a sliding latch mounted on the door including a latch plate and a latch bolt. A latch bolt defines a cam surface engagable with the jamb to cam the latch bolt away from the jamb as the door is closed. Biasing springs are utilized to bias the latch bolt outwardly with respect to the latch plate and to bias the latch plate and latch bolt together outwardly with respect to the door jamb. A detent prevents movement between the latch plate and the latch bolt when the latch is mounted on a door and latched behind a door jamb.

12 Claims, 6 Drawing Sheets

LATCH

BACKGROUND OF THE INVENTION

1. Field of the Invention

The present invention relates to a latch mechanism for hinged doors such as locker doors and more specifically to a lockable latch mechanism incorporating a sliding latch bolt.

2. Description of the Prior Art

A successful latch mechanism utilizing a spring-projected padlock-lockable latch bolt is disclosed in U.S. Pat. No. 3,374,020, issued Mar. 19, 1968, to R. D. W. Berg for "Latch Mechanism." This latch mechanism is utilized on a hinged door such as a locker door and, in the absence of a padlock, allows the door to be swung closed with the latch sliding in its mounting for engaging the locker frame or door jamb. Upon insertion of a padlock, the latch mechanism is securely and immovably locked. While this latch mechanism has proven to be commercially successful, it has the disadvantage of requiring that the padlock be completely removed from the latch mechanism before the locker door can be closed and locked.

OBJECTS OF THE INVENTION

It is the principal object of the present invention to provide an improved padlock lockable latch mechanism for a locker door.

Another object of the present invention is to provide an improved latch mechanism which allows a locker door to be closed and latched when a padlock is secured in place on the latch mechanism.

A further object of the present invention is to provide a latch mechanism of the foregoing character which precludes unauthorized opening of the latch and theft of the locker contents.

A further object of the present invention is to provide a latch mechanism of the foregoing character which is simple yet extremely rugged to prevent smashing or bending of the latch mechanism resulting in release of the latch.

Still a further object of the invention is to provide a latch mechanism of the foregoing characteristics which provides dead bolt security while allowing the locker door to be closed when the padlock is latched in place.

SUMMARY OF THE INVENTION

In order to prevent the loss or misuse of a padlock while the locker door is open, it is desirable for the locker user to be able to reinsert the padlock in the latch and lock it while the locker door is open. When access to the locker is completed, it is desirable to be able to close the locker door notwithstanding the presence of the padlock. At the same time it is desirable that the latch be a dead bolt style latch to prevent unauthorized opening of the locker, even though the locker door might have an open or cage-type front panel.

In accordance with the foregoing objects, the present invention is embodied in a lockable latch mechanism for locking a hinged door to a door jamb or frame. The latch mechanism is adapted to receive a hasp of a padlock for locking the latch to prevent opening the door. The latch mechanism comprises an L-shaped latch plate slidably mounted on the door, one leg of the latch comprising a latch bolt and the other leg defining a lockable trigger. The trigger when unlocked is slidable to slide the latch bolt to release the door for opening from the jamb. The latch plate comprises a bifurcated plate integral with the trigger and extending along the door towards the jamb in a plane normal to the plane of the door. The plate defines inner and outer spaced-apart parallel arms between which a latch bolt is slidably positioned. A spring acts between the latch bolt and the plate and biases the bolt outwardly of the plate in the plane thereof. The latch bolt defines a sloping cam surface on the rounded outer jamb engaging end thereof. Engagement between the latch bolt cam surface and the door jamb as the door is closed urges the latch between the arms against the bias of the spring. This slides the latch bolt past the door jamb, and when the door is closed, the latch bolt snaps into place behind the jamb, securely latching the door. A detent is engagable between the outer arm of the latch plate and the latch bolt for preventing sliding movement of the latch bolt relative to the latch plate when the door is closed and locked. A variety of detents may be utilized, the preferred one of which is a V-shaped leaf spring, one leg of which is strengthened by folding the tip of the spring back on itself. Alternative leaf springs may be utilized as may be other forms of detents.

DESCRIPTION OF THE PREFERRED EMBODIMENT

Figure 1:
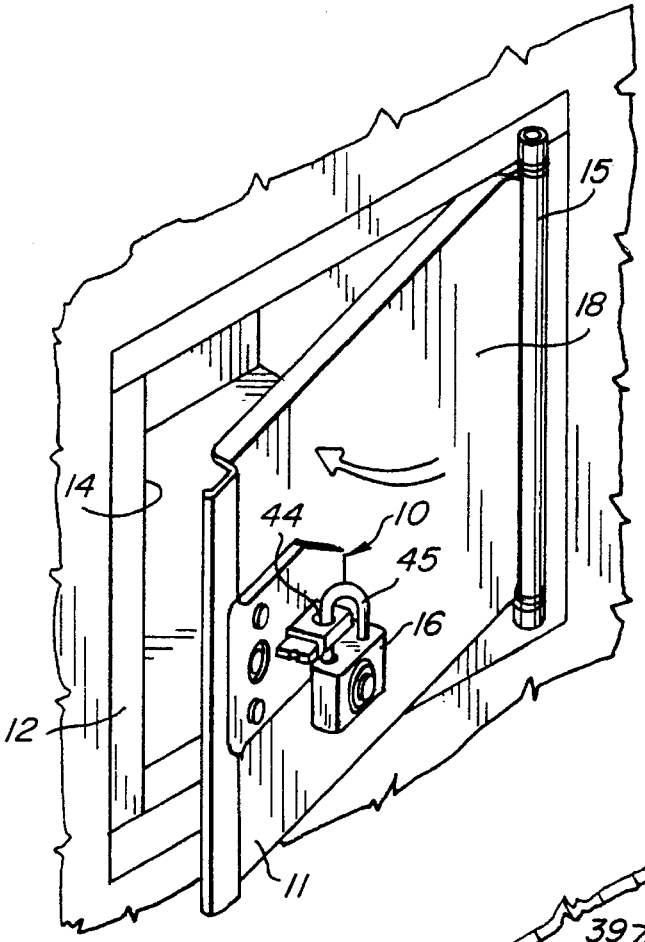
FIG. 1 is a perspective view of a locker door jamb and lock embodying the present invention.

The present invention is embodied in a latch 10 finding particular but not exclusive utility for locking a door 11, such as a locker door, to the door frame or jamb 12. The door 11 is mounted by a hinge 15 in an opening 14 defined in the frame or jamb 12. The latch 10 engages the jamb 12 and locks the door 11 therein. A padlock 16 in turn locks the latch 10 and must be removed before the latch 10 can be released so that the locker door 11 can be opened. The door 11 may be solid or may be of a heavy metal mesh 18, as shown in FIG. 1, which provides both ventilation to the locker as well as visual access thereinto. When the door 11 is open, the latch 10 may first be locked by a padlock 16, and the door then closed. When the door 11 is closed, the latch mechanism engages the door jamb 12 as a dead bolt, and the door 11 is securely locked until the padlock 16 is removed to enable the latch to be released.

Figure 2:
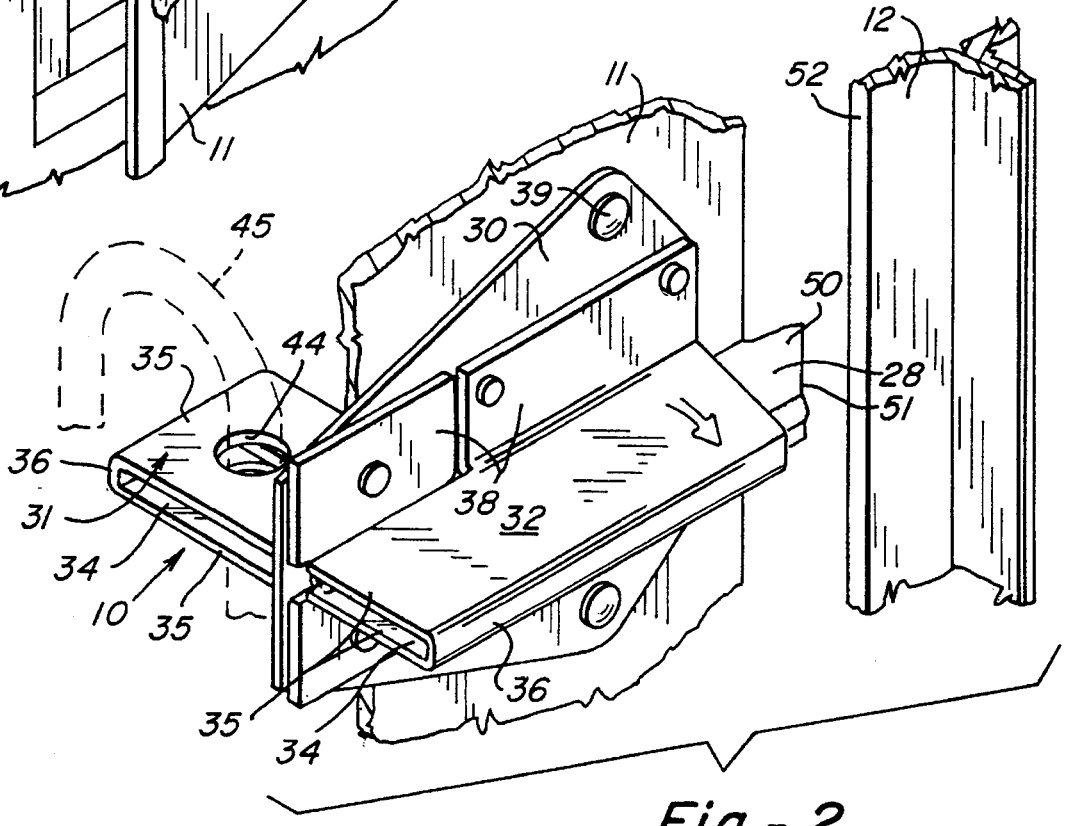
FIG. 2 is an enlarged perspective view of a lock embodying the present invention as shown from the rear of FIG. 1 with parts of the door and jamb cut away for clarity.
Figure 3:
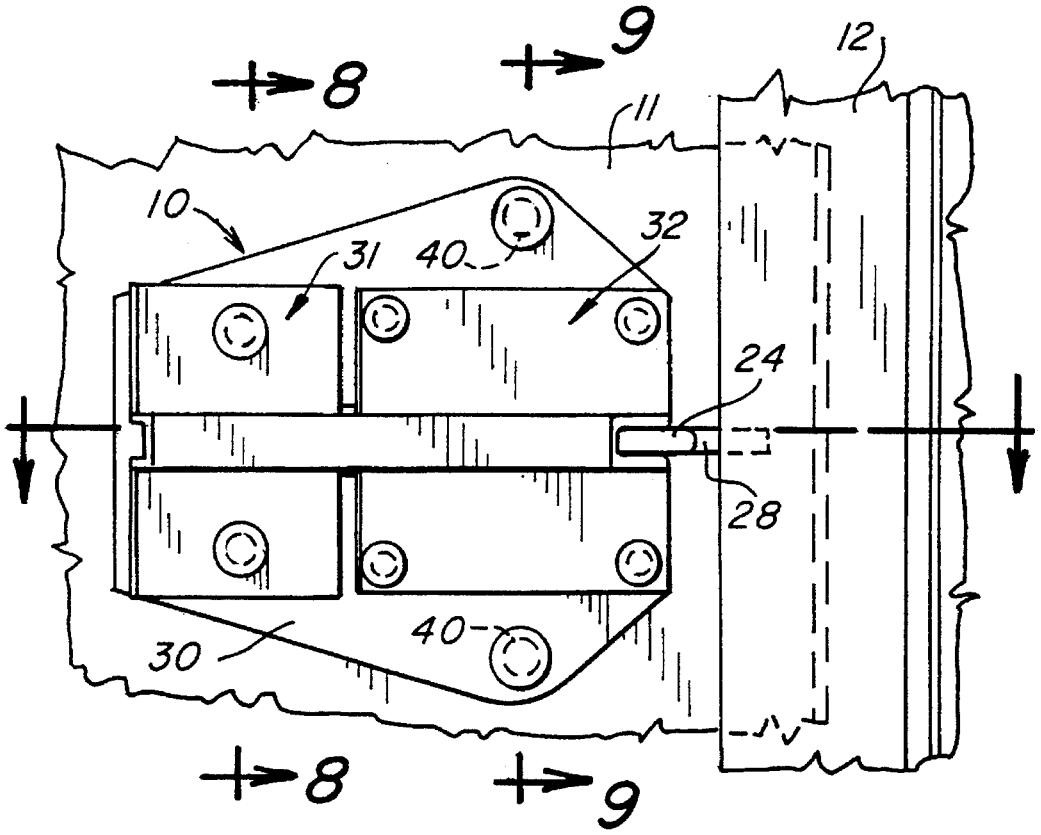
FIG. 3 is a rear elevation view of the latch and door shown in FIG. 2
Figure 4:
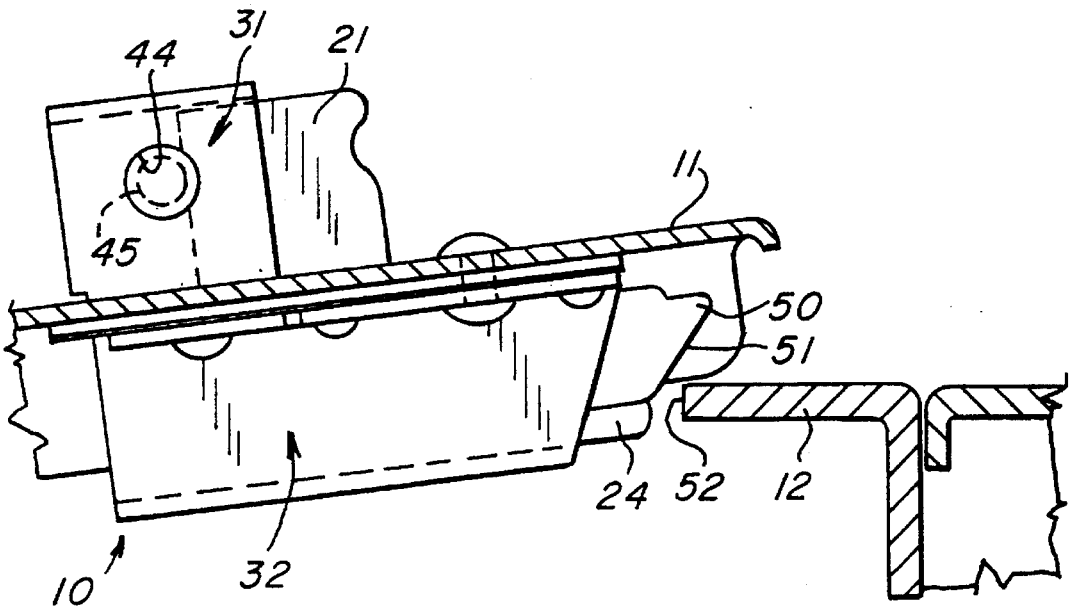
FIG. 4 is a top plane view of the latch shown in FIG. 3 with the door in section.

The latch mechanism 10 embodying the present invention is formed by a generally L-shaped, relatively thin, latch body or plate 20 (FIG. 5) defining a trigger leg 21 and an integral bifurcated latch bolt leg 22 extending laterally therefrom. The latch bolt leg 22 includes a longer outer arm 24 and a shorter inner arm 25 defining therebetween a latch bolt slot 26 for receiving and retaining a latch bolt 28. The latch plate 20 is slidingly retained on a mounting plate 30 (FIG. 2) by a pair of oppositely directed channel brackets 31, 32 secured to the mounting plate 30 and respectively enclosing and supporting the trigger and latch bolt legs 21, 22 of the latch plate 20. Each channel bracket 31, 32 is formed with a latch plate receiving channel 34 defined by a pair of spaced channel walls 35 joined at one edge by a web 36 and having out-turned flanges 38 integral with the opposite edges of the walls and adapted to be secured to the mounting plate 30 by welding, rivets, bolts or other appropriate fasteners.

The mounting plate 30 is mounted on the door 11, as shown in FIG. 1, by appropriate bolts or rivets 39 which extend through corresponding holes 40 in the door and mounting plate. For receiving the trigger leg 21 and enclosing channel bracket 31, an elongated trigger slot 41 is provided in the mounting plate 30. A corresponding slot 42 is provided in the door 11 for receiving inserted trigger 21 and trigger channel bracket 31.

For receiving a padlock hasp 45, the trigger channel bracket 31 is provided with holes 44 through which the hasp 45 of the padlock 16 may be inserted to prevent sliding movement of the trigger 21 in the bracket 31 and thereby lock the latch 10.

Figure 11:
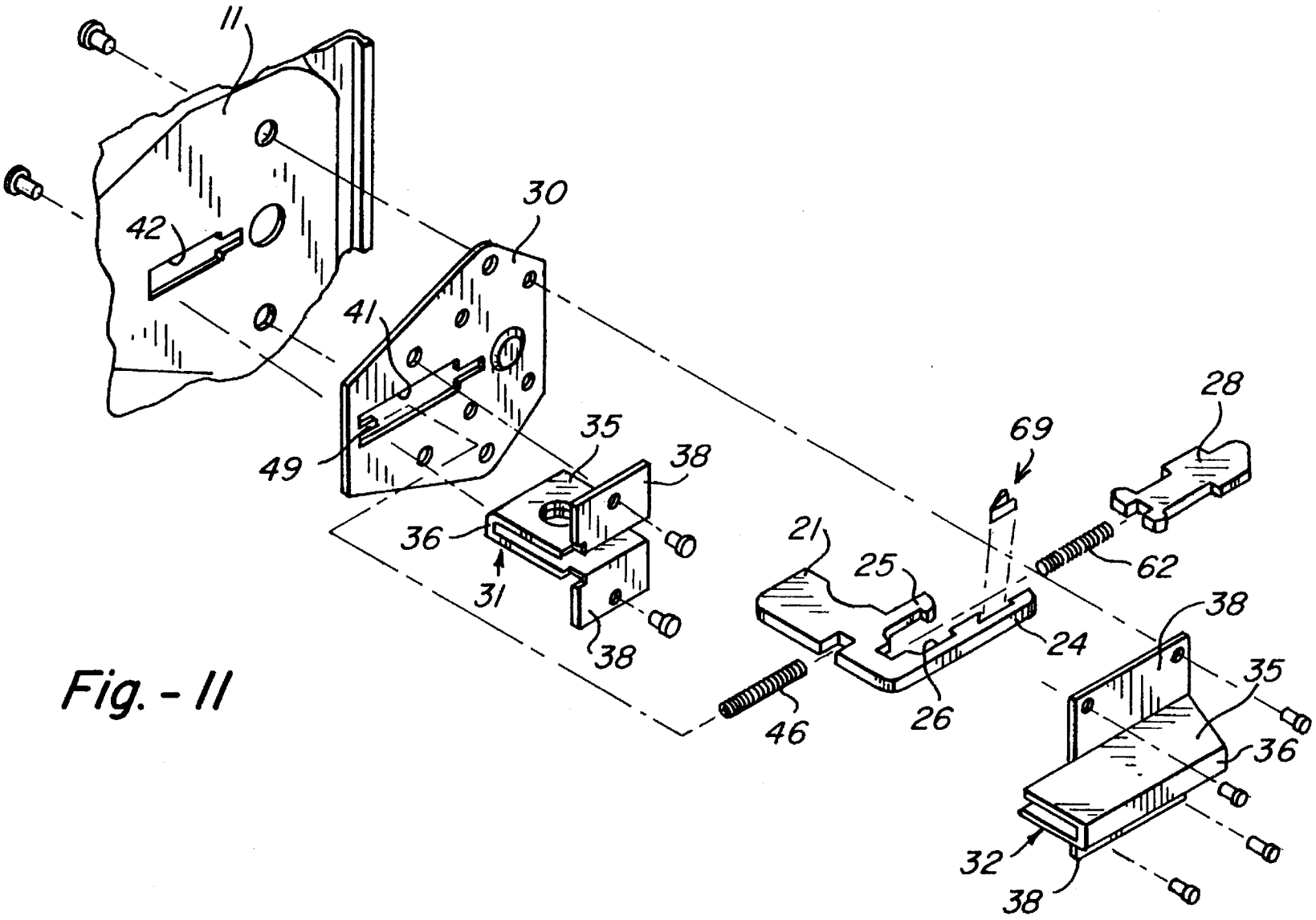
FIG. 11 is an exploded perspective view of the latch embodying the present invention.

When the padlock hasp 45 is removed from the trigger bracket 31, the trigger 21 can be slid into the channel bracket 31 against the biasing force of a latch spring 46 to slide the latch plate 20 and latch bolt 28 to release the bolt 28 from the door jamb 12 and unlock the door 11. The latch spring 46 is positioned in a notch 48 formed in the latch plate 20 (FIG. 5), and is supported on a pin 49 integrally formed in the mounting plate 30 and projecting into the trigger slot 41 formed therein (FIG. 11).

Figure 7:
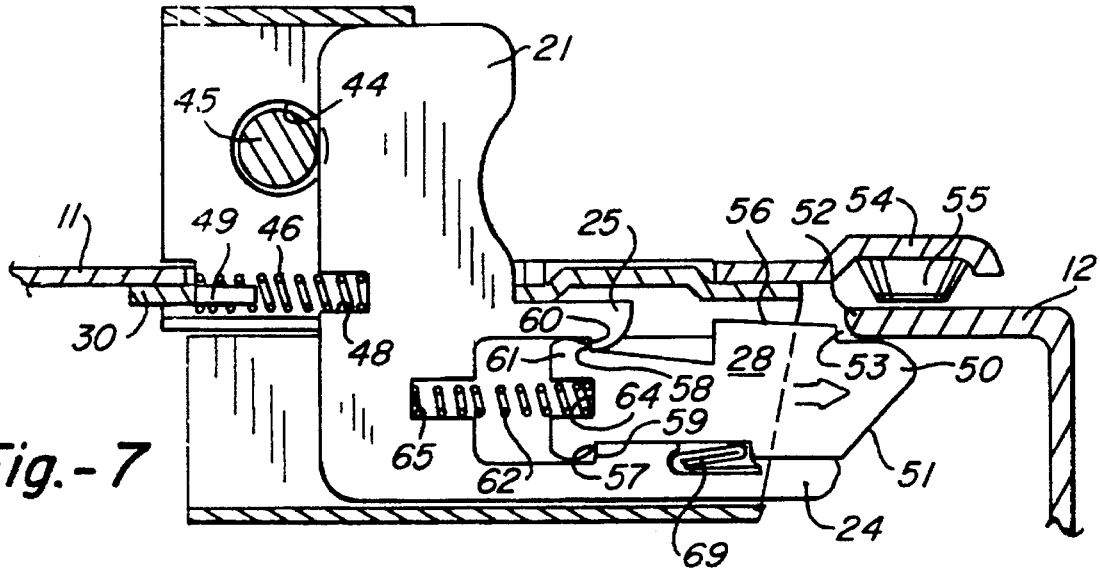
FIG. 7 is a section view similar to FIG. 5 but with the door closed.
Figure 6:
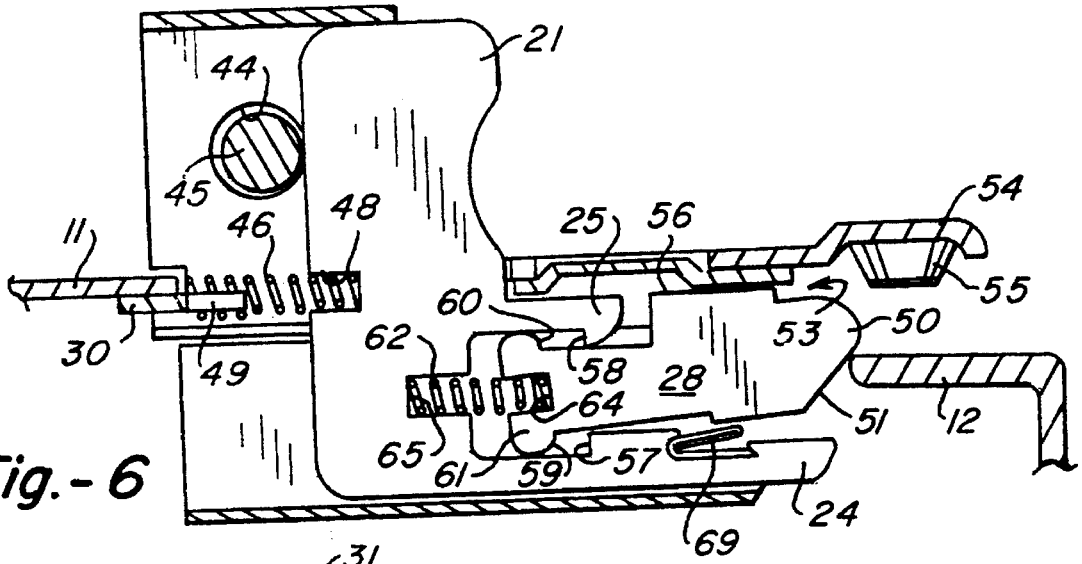
FIG. 6 is a section view similar to FIG. 5 but with the door partially closed.
Figure 5:
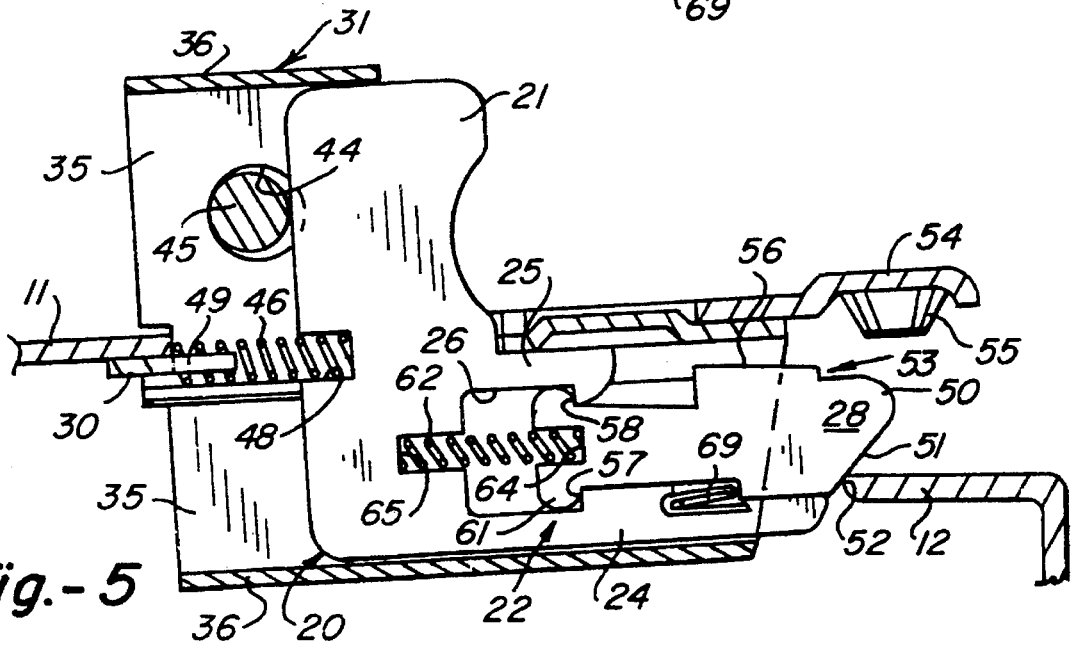
FIG. 5 is a section view taken substantially in the plane of line 5—5 on FIG. 3 and showing the door open.
Figure 8:
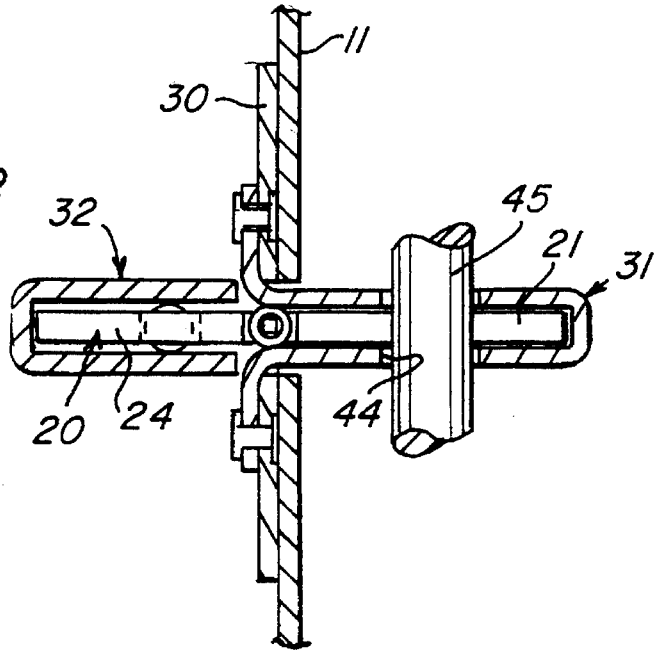
FIG. 8 is a section view taken substantially in the plane of line 8—8 on FIG. 3.
Figure 9:
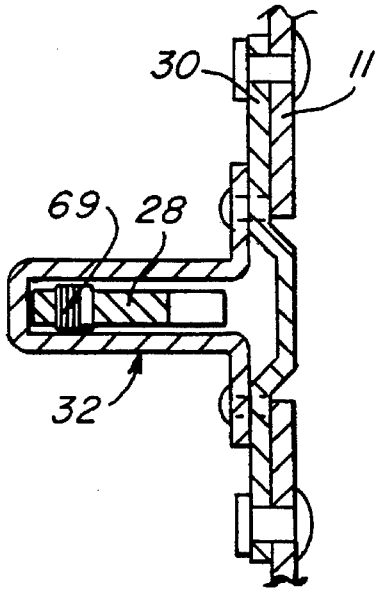
FIG. 9 is a section view taken substantially in the plane of line 9—9 on FIG. 3.

For latching engagement with the jamb 12, the latch bolt 28 is slidingly and swingably supported within said latch bolt slot 26 between the outer arm 24 and the inner arm 25 of the latch plate 20 (FIG. 5). The latch bolt 28 defines a rounded outer nose portion 50 and a forward sloping cam surface 51 which, upon engagement with an edge 52 of the frame or jamb 12 (FIG. 6) cams the latch bolt 28 slidingly rearwardly into the latch bolt slot 26 so that the nose 50 passes and clears the edge 52 of the jamb 12. After the nose 50 is cammed past the jamb edge 52, the latch bolt 28 slides forwardly over the jamb 12 (FIG. 7). For receiving a corner of the jamb 12, a notch 53 is cut in the side edge 56 of the latch bolt 28 adjacent the nose 50.

To ensure that the latch bolt 28 securely engages the jamb 12 when the door 11 is closed, an edge flange 54 on the door overlaps the jamb edge 52 and is provided with resilient stops 55 which engage the door jamb 12. The stops 55 position the door 11 so that the latch bolt 28 has sufficient clearance to engage behind the jamb edge leaving only a minimum gap between the notch 53 with bolt 28 and the jamb 12, as shown in FIG. 7, so that the door 11 is tightly shut.

For loosely slidably and swingably retaining the latch bolt 28 in the latch bolt slot 26, the outer and inner latch plate arms 24, 25 each define rearwardly facing shoulders 57, 58, which engage corresponding forwardly facing shoulders 59, 60 on a rounded, enlarged inner end 61 of the latch bolt 28. To enable the latch bolt 28 to swing away from the longer outer arm 24, the inner arm 25 is substantially shorter than the outer arm 24, about one-half as long as shown in the drawings.

For biasing the latch bolt 28 outwardly or forwardly with respect to the latch plate slot 26 and arms 24, 25, a biasing spring 62 is positioned in notches 64, 65 in the latch bolt 28 and latch plate 20, respectively, and extends generally axially of the latch bolt slot 26. The latch bolt 28 can be slid inwardly or rearwardly against the biasing force of the spring 62 by engagement of the cam surface 51 with the edge 52 of the jamb 12. As the latch bolt 28 passes the jamb 12, the biasing spring 62 snaps the latch bolt outwardly into engagement behind the frame or jamb 12 with the corner of the edge 52 of the jamb 12 nesting in the bolt notch 53 as shown in FIG. 7.

As described above, to release the latch bolt 28 from the jamb 12 when the padlock 16 is removed, the trigger 21 is pulled against the force of the latch biasing spring 46, so that the latch bolt slot shoulders 56, 58 engage the latch bolt head shoulders 59, 60 to pull the latch bolt 28 away from the jamb 12 and allow the door 11 to open.

For preventing manual or nontrigger actuation of the latch bolt 28 to open the door 11 when the padlock is secured in place with the hasp 45 in the locking holes 44 in the trigger channel bracket 31, a detent 68 is provided between the outer latch plate arm 24 and the latch bolt 28. To this end, a generally V-shaped detent spring 69 is positioned in a notch 70 defined in the slot-facing edge of the outer latch plate arm 24 and extends into a notch 71 defined in the adjoining edge of the latch bolt 28. The latch bolt notch 71 defines a detent shoulder 72 which, when the latch bolt 28 is in an extended position, engages one end 73 of the detent spring 69 and prevents sliding movement between the latch bolt 28 and the latch plate 20 (FIG. 10).

When a padlock 16 and hasp 45 are locked in place in the trigger channel 31 to prevent movement of the trigger 21, and the door 11 is swung to close and secure the latch, the latch bolt 28 engages the jamb by engagement between the sloping latch bolt cam surface 51 and the jamb edge 52. As the latch is closed against the jamb 12, the cam surface 51 engages the jamb edge 52 and swings the latch bolt 28 away from the upper latch plate arm 24 to release the detent spring 69 from the detent notch 71 so that the latch bolt 28 slides laterally against the force of the biasing spring 62. After the nose of the latch bolt has passed the jamb 12, the spring 62 urges the latch bolt outwardly, slightly compressing the detent spring 69 until the detent spring passes the detent shoulder on the latch bolt, at which point the detent spring snaps into position in the notch 71 behind the detent shoulder 72 of the latch bolt. With this construction, manual or unauthorized actuation of the latch bolt 28 cannot be effected without pulling on the latch trigger 21.

Figure 10:
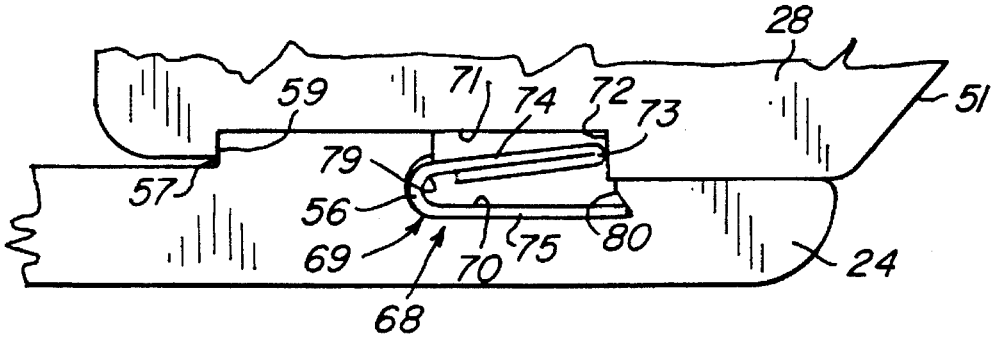
FIG. 10 is an enlarged plane view of the detent shown in FIG. 5.
Figure 12:
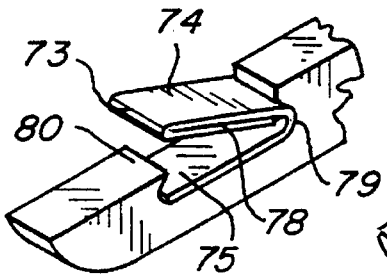
FIG. 12 is an enlarged perspective view of the detent shown in FIG. 5.

While any appropriate detent structure or mechanism 68 may be utilized to prevent retraction of the latch bolt 28 with respect to the latch plate 20 when the door 11 is closed and locked, the preferred detent 68 is a detent spring 69 shaped as shown in FIGS. 10 and 12. This spring 69 constitutes a V-shaped leaf spring with diverging legs 74, 75 joined at an apex 76. The free end 78 of one of the legs 74 is folded inwardly back on itself to provide additional rigidity to the leg 74, the end 73 of which serves the detent function upon engagement with the latch bolt detent shoulder 72. For retaining the detent spring 69 in the latch plate notch 70, one lateral edge of the notch defines a channel 79 for receiving the apex 76 of the left spring detent 68, while the other lateral edge is upset or defines a retaining lip 80 which engages and retains the outer edge of the other spring leg 75.

Upon closing the door with a padlock in place as described above, the cam edge or surface 51 on the latch bolt 28 engages the door jamb 12. The closing action of the door cams the latch bolt into the latch plate slot 26 so that the latch bolt nose 50 passes and clears the edge 52 of the jamb 12. This action swings the latch bolt 28 away from the outer latch plate arm 24 so that the detent spring 69 clears the notch 71 in the latch plate allowing the latch bolt 28 to slide sufficiently rearwardly to allow the door to close. When the door is closed, the detent spring leg 74 is urged inwardly by engagement with the outer edge of the latch bolt 28. The latch bolt biasing spring 62 forces the latch bolt outwardly into locking position at which point the detent spring leg 74 springs into the latch plate notch 71 to prevent subsequent retraction of the latch bolt 28 relative to the latch plate 20.

Figure 16:
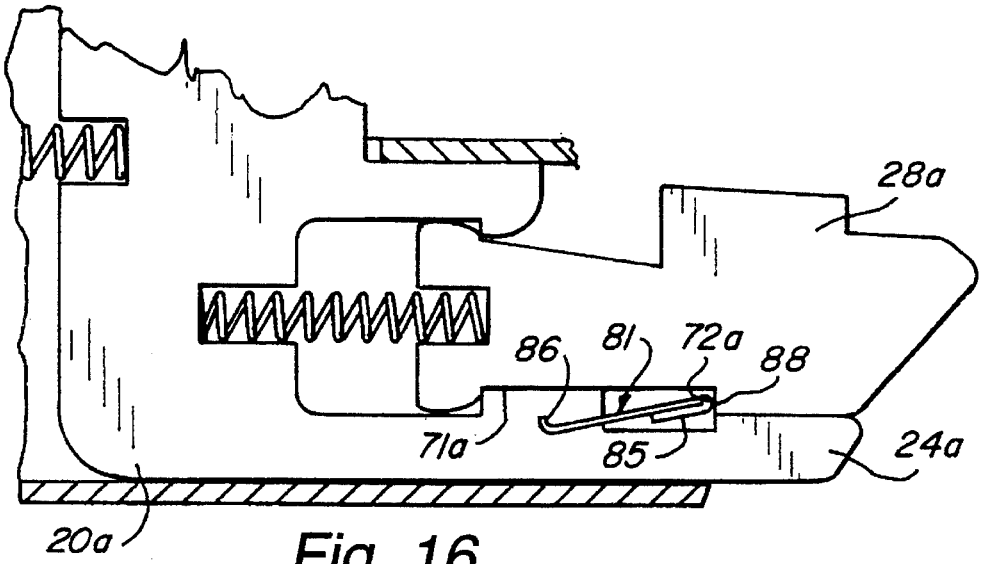
FIG. 16 is a plane view similar to FIG. 5 but using the detent shown in FIG. 11.
Figure 15:
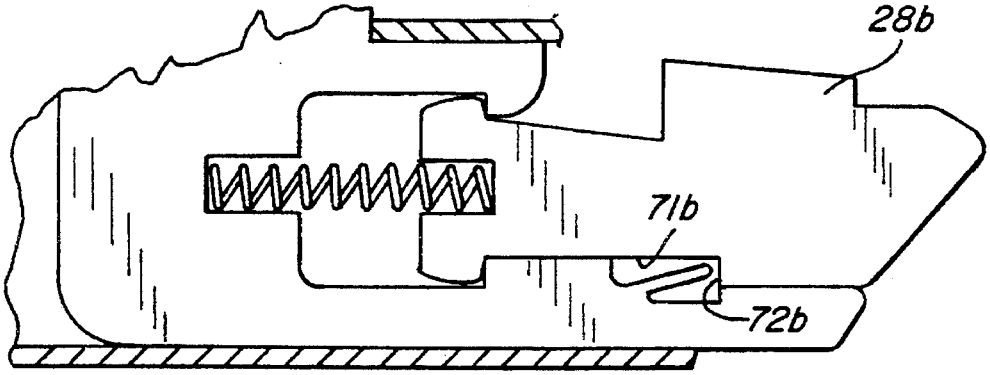
FIG. 15 is a plane view similar to FIG. 5 but using the detent shown in FIG. 13.
Figure 13:
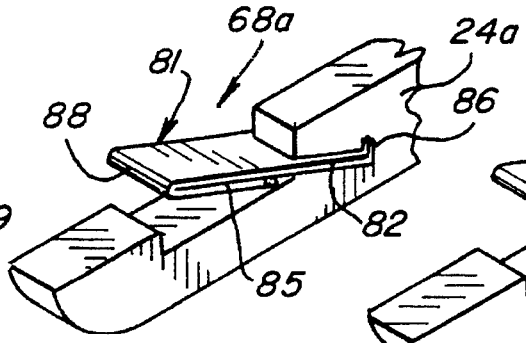
FIG. 13 is an enlarged perspective view of a modified form of detent.

Two modified forms of the detent are shown in FIGS. 13 and 16. In describing these modified forms of the detent, reference numerals similar to those used above will be utilized where applicable with the distinguishing suffixes "a" and "b" respectively. These modified forms of the detent are particularly useful when the latch plate is constructed of a molded or otherwise shaped high impact plastic material.

In FIG. 13 the detent **68*a* shown is formed by a single leg leaf spring 81, one end 82 of which is embedded in the outer latch plate arm 24*a* of the latch plate 20*a* and with the free end 84 extending into the arm notch 70*a* (FIG. 16). The outer end 85 of the leaf spring is folded back on itself to provide a stronger spring detent. The inner, embedded end is slightly inturned to provide a lip 86 which strengthens the engagement between the leaf spring 81 and the latch plate 20. The operation of the leaf spring detent is as described above, the tip end 88 of the leaf spring engaging the detent shoulder 72*a* formed in the latch bolt notch 71*a* of the latch bolt 28*a***.

Figure 14:
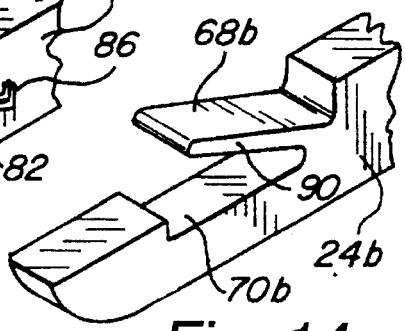
FIG. 14 is an enlarged perspective view of a further modified form of detent.

A further detent modification is shown in FIG. 14. In this modification, the detent **68*b* is formed by an integral leaf 90 formed as a part of the outer latch plate arm 24*b* and extending over the arm notch 70*b* for engagement with the detent shoulder 72*b* formed by the detent notch 71*b* in the latch bolt 28*b*. The detent arm 90 is of sufficient flexibility to be deformed into the notch 70*b* when the latch bolt 28*b* slides over the arm 24*b* after being cammed rearwardly by engagement of the cam surface 51*b*** on the door jamb (not shown) as the door (not shown) is closed.

The latch components may be made of any appropriate material depending on the conditions of use. For the most part, the latch parts will be made of steel plate although various tough high impact plastic materials such as nylon may be utilized.

A hinged door having a latch of the character shown can be unlocked and opened by removing the padlock, and the padlock inserted back into place and immediately locked while the door is open. After access to the enclosed locker has been completed, it is necessary only to close the door to lock it. The latch bolt allows the door to be closed and locked even though a padlock or other lock is inserted and locked into place. The advantages of such a mechanism are that locks which are immediately relocked into place are less likely to be lost or mixed up with another locker or its padlock. The lock is not set aside on the floor or top of the locker but is inserted directly into place thereby substantially reducing the incidence of lost, misplaced or mixed locks. At the same time, the latch provides a dead bolt style latch when the door is closed, making it impossible to release the latch bolt by use of a wire, card or other lock pick.

While certain illustrative modifications of the present invention have been shown in the drawings and described above in considerable detail, it should be understood that there is no intention to limit the invention to the specific forms disclosed. On the contrary, the intention is to cover all modifications, alternative constructions, equivalents and uses falling within the spirit and scope of the invention as expressed in the appended claims.

I claim:

1. A lockable latch mechanism for receiving the hasp of a padlock and locking a hinged door to a jamb to prevent opening of the door when the door is closed and the lockable latch mechanism is in engagement with the jamb, comprising a sliding latch mounted on said door, said latch including a latch plate, a latch bolt on said latch plate engagable with said jamb to retain said door in a locked position, said latch bolt defining a cam surface engagable with said jamb to cam said latch bolt away from said jamb as said door is closed, a first spring biasing said latch plate relative to said door toward said jamb, a second spring biasing said latch bolt relative to said latch plate toward said jamb, said latch plate loosely retaining said latch bolt for sliding and swinging movement relative thereto, and a detent acting between said latch bolt and said latch plate for restraining said latch bolt against sliding movement relative to said latch plate when said door is closed and said latch bolt is engaged with said frame, said detent being disengaged during the closing of said door allowing said latch bolt to swing and slide relative to said latch plate so that said door can be closed without releasing said latch plate for movement relative to said door.

2. A lockable latch mechanism for locking a hinged door to a door jamb frame and for receiving a hasp of a padlock to prevent opening of the door, said latch mechanism comprising an L-shaped latch plate slidably mounted on said door, one leg of said latch plate defining a lockable actuating trigger, said trigger when unlocked being slidable to slide said latch plate to release the door for opening from said jamb, a second leg of said latch plate defining a bifurcated plate integral with said trigger and extending along said door toward said jamb in a plane normal to the plane of said door, said bifurcated plate defining inner and outer spaced apart parallel arms, a latch bolt slidably positioned between said arms, a spring acting between said bolt and said latch plate and biasing said bolt outwardly of said latch plate in the plane thereof, said latch bolt defining a sloping a cam surface on the outer jamb engaging end thereof, engagement between said latch bolt cam surface and said door jamb during closing of said door urging said latch bolt between said arms against the bias of said spring thereby to slide said latch bolt past said door jamb during closing of said door and enabling latching engagement of said latch bolt behind said jamb when said trigger is locked, and a detent engagable between the outer arm of said latch plate and said latch bolt for preventing sliding movement of said latch bolt relative to said latch plate when said door is closed and locked.

3. A lockable latch mechanism as defined in claim 2 wherein said detent comprises a leaf spring.

4. A lockable latch mechanism as defined in claim 3 wherein said detent comprises a V-shaped leaf spring.

5. A lockable latch mechanism as defined in claim 4 wherein said V-shaped leaf spring is formed by a pair of diverging spring legs joined at an apex at one end thereof, the free end of one of said legs being folded back on itself to provide a detent end edge.

6. A lockable latch mechanism as defined in claim 3 wherein said detent is a leaf spring having one end folded back on itself to form a detent edge.

7. A lockable latch mechanism as defined in claim 2 wherein said detent is formed integrally with said latch plate.

8. A lockable latch mechanism for locking a hinged door to a door jamb frame and for receiving a hasp of a padlock for locking the latch to prevent opening of the door, said latch mechanism comprising an L-shaped latch plate slidably mounted on said door, a latch plate spring acting between said door and said latch plate and biasing said latch plate towards said jamb, one leg of said latch defining a lockable actuating trigger, said trigger when unlocked being slidable to slide said latch plate against the bias of said latch plate spring to release the door for opening from said jamb, a second leg of said latch plate defining a bifurcated plate integral with said trigger and extending along said door toward said jamb in a plane normal to the plane of said door, said bifurcated plate defining inner and outer spaced apart parallel arms, each said arm defining a rearwardly facing shoulder, a latch bolt slidably positioned between said arms, said latch bolt defining an enlarged head on the rearward end thereof, said head defining forwardly facing shoulders adapted for driving engagement with said rearwardly facing shoulders on said arms when said trigger is pulled to release said latch bolt from said jamb, a spring acting between said bolt and said latch plate and biasing said bolt outwardly of said latch plate in the plane thereof, said latch bolt defining a sloping cam surface on the outer jamb engaging end thereof, engagement between said latch bolt cam surface and said door jamb during closing of said door urging said latch bolt between said arms against the bias of said spring thereby to slide said latch bolt past said door jamb during closing of said door and enabling latching engagement of said latch bolt behind said jamb when said trigger is locked, and a detent engagable between the outer arm of said latch plate and said latch bolt for preventing sliding movement of said latch bolt relative to said latch plate when said door is closed and locked.

9. A lockable latch mechanism as defined in claim 8 wherein said detent comprises a leaf spring.

10. A lockable latch mechanism as defined in claim 9 wherein said detent comprises a V-shaped leaf spring.

11. A lockable latch mechanism as defined in claim 10 wherein said V-shaped leaf spring is formed by a pair of diverging spring legs joined at an apex at one end thereof, the free end of one of said legs being folded back on itself to provide a detent end edge.

12. A lockable latch mechanism for receiving the hasp of a padlock and locking a hinged door to a jamb to prevent opening of the door when the door is closed and the latch is in engagement with the jamb, comprising a sliding latch mounted on said door, said latch including a latch plate, a latch bolt on said latch plate engagable with said jamb to retain said door in a locked position, said latch bolt defining a cam surface engagable with said jamb to cam said latch bolt away from said jamb as said door is closed, said latch plate loosely retaining said latch bolt for sliding and swinging movement relative thereto, and a detent acting between said latch bolt and said latch plate for restraining said latch bolt against sliding movement relative to said latch plate when said door is closed and said latch bolt is engaged with said frame.

* * * * *